US007286059B2

(12) United States Patent
Drake

(10) Patent No.: US 7,286,059 B2
(45) Date of Patent: Oct. 23, 2007

(54) TALKING TOOL HOLDER

(76) Inventor: Earl Clifton Drake, 20101 Elm Rd., Joplin, MO (US) 64801

( * ) Notice: Subject to any disclaimer, the term of this patent is extended or adjusted under 35 U.S.C. 154(b) by 106 days.

(21) Appl. No.: 10/960,138

(22) Filed: Oct. 7, 2004

(65) Prior Publication Data

US 2006/0082466 A1 Apr. 20, 2006

(51) Int. Cl.
*G08B 21/00* (2006.01)

(52) U.S. Cl. ..... 340/686.1; 340/568.1; 340/566; 340/691; 340/660; 340/692; 206/217; 206/581; 206/438; 206/561

(58) Field of Classification Search ..... 340/692, 340/686.1, 568.1, 566, 571, 691, 660; 705/2, 705/3; 206/217, 561, 581, 564, 438
See application file for complete search history.

(56) References Cited

U.S. PATENT DOCUMENTS

| | | | | | |
|---|---|---|---|---|---|
| 3,760,489 | A | | 9/1973 | Griffith | 29/568 |
| 4,535,659 | A | | 8/1985 | Yang | 81/478 |
| 4,621,738 | A | * | 11/1986 | DeLucchi | 211/70.6 |
| 4,742,470 | A | | 5/1988 | Juengel | 364/474 |
| 4,800,786 | A | | 1/1989 | Arnold et al. | 81/121.1 |
| 4,841,653 | A | | 6/1989 | Negley | 40/625 |
| 4,982,627 | A | | 1/1991 | Johnson | 81/121.1 |
| 5,031,488 | A | | 7/1991 | Zumeta | 81/180.1 |
| 5,099,463 | A | * | 3/1992 | Lloyd et al. | 368/10 |
| 5,181,439 | A | | 1/1993 | Schwartz | 81/119 |
| 5,257,199 | A | | 10/1993 | Tsujino et al. | 364/474.02 |
| 5,328,029 | A | * | 7/1994 | Chow | 206/378 |
| 5,421,224 | A | | 6/1995 | Bond | 81/436 |
| 5,819,606 | A | | 10/1998 | Arnold | 81/124.3 |
| 5,954,225 | A | * | 9/1999 | Powe | 221/2 |
| 5,957,012 | A | | 9/1999 | McCune | 81/180.1 |
| 6,082,227 | A | | 7/2000 | Vogel | 81/119 |
| 6,591,227 | B2 | | 7/2003 | Koehler | 702/183 |
| 6,693,537 | B2 | * | 2/2004 | Frank | 340/568.1 |
| 6,731,218 | B2 | | 5/2004 | Lubke et al. | 340/660 |
| 2003/0199856 | A1 | | 10/2003 | Hill et al. | 606/1 |
| 2003/0221954 | A1 | | 12/2003 | Hsien | 204/232 |
| 2004/0094602 | A1 | | 5/2004 | Lin | 228/51 |

OTHER PUBLICATIONS

Walgreens.com web page printout for Talking Rx product, Jun. 7, 2004.

* cited by examiner

*Primary Examiner*—Tai Nguyen
(74) *Attorney, Agent, or Firm*—Martin & Associates, LLC; Derek P. Martin

(57) ABSTRACT

A talking tool holder provides an audio message in response to a user selection that indicates the size of the tool the user has selected. The talking tool holder includes a housing with multiple uniquely-sized tool-receiving locations, with a corresponding sensor for each tool-receiving location. The unique size of each tool-receiving location aids a user in putting the corresponding tools back in their proper locations. When a user needs a too, the user actuates with a finger a sensor in proximity to a tool-receiving location. In response, an audio mechanism plays an audio message corresponding to the tool-receiving location selected by the user, such as an indication of size or type of tool for the selected tool-receiving location. In this manner, a user may receive audio messages for selected tools in the tool holder that indicate size or type of the tool corresponding to the tool-receiving location.

30 Claims, 4 Drawing Sheets

TALKING TOOL HOLDER

BACKGROUND OF THE INVENTION

1. Technical Field

This invention generally relates to hand tools, and more particularly relates to holders for hand tools.

2. Background Art

Many different kinds of holders for various types of hand tools have been developed over the years. For example, socket holders are known that receive several different-sized sockets. One problem with many known socket holders is that the size of the sockets are very hard to read, both on the sockets themselves and on the holders for the sockets. In an attempt to alleviate the difficulty of reading the size of a socket, some color-coded schemes have been developed that allow a user to determine the size of the socket according to a number of color bands on the sockets. Color-coded systems, however, require the user to learn the color coding system. In addition, known visual identification systems will not work for those that have severe visual impairment or no vision at all.

DISCLOSURE OF INVENTION

According to the preferred embodiments, a talking tool holder provides an audio message in response to a user selection that indicates the size of the tool the user has selected. The talking tool holder includes a housing with multiple uniquely-sized tool-receiving locations, with a corresponding sensor for each tool-receiving location. The unique size of each tool-receiving location aids a user in putting the corresponding tools back in their proper locations. When a user needs a too, the user actuates with a finger a sensor in proximity to a tool-receiving location. In response, an audio mechanism plays an audio message corresponding to the tool-receiving location selected by the user, such as an indication of size or type of tool for the selected tool-receiving location. In this manner, a user may receive audio messages for selected tools in the tool holder that indicate size or type of the tool corresponding to the tool-receiving location.

The talking tool holder of the preferred embodiments provides a way for someone with poor vision or no vision to easily determine the size of a tool located in the talking tool holder. In addition, a mechanic that is busy could also easily determine the size of a tool by actuating a sensor next to one of the tool-receiving locations, which causes the talking tool holder to play an audio message indicating the size or type of the tool stored in the selected tool-receiving location.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The preferred embodiments provide a talking tool holder that provides an audio indication of a size or type of tool stored in the tool holder. The talking tool holder includes multiple uniquely-sized tool-receiving locations, with a finger-actuated sensor in proximity to each tool-receiving location. When a user actuates a sensor, an audio message is played that corresponds to the selected tool-receiving location, such as indicating size of a tool that the selected tool-receiving location is designed to receive.

Figure 1:
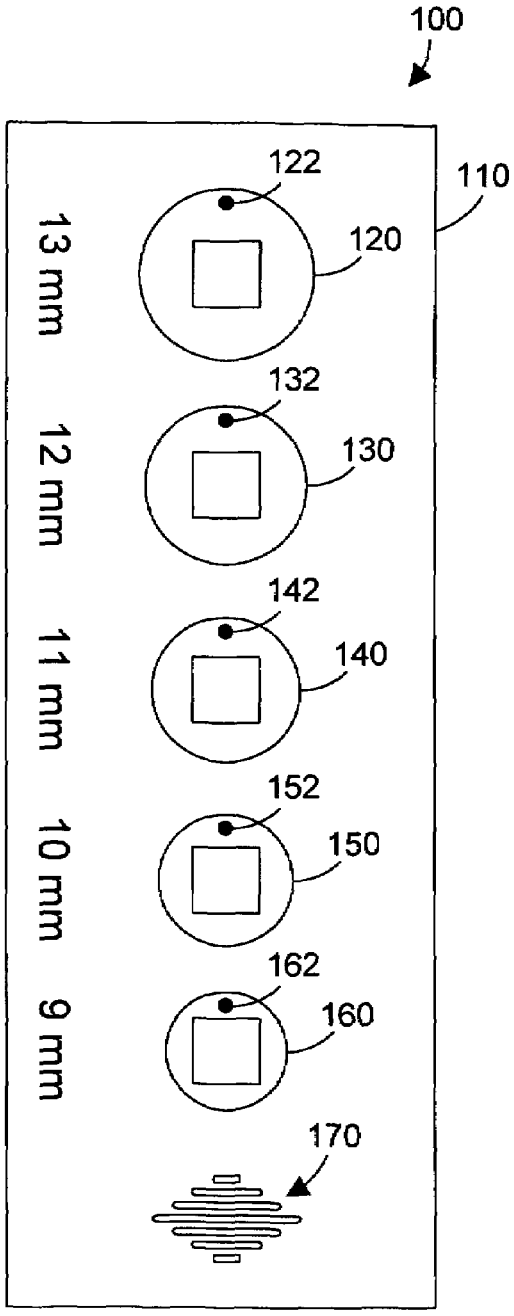
FIG. 1 is a top view of a talking tool holder in accordance with a first embodiment.

Referring to FIG. 1, a socket holder 100 is one specific example of a talking tool holder in accordance with a first embodiment. The socket holder 100 includes a housing 110. Housing 110 is preferably made of injection-molded plastic, but could be made of any suitable material within the scope of the preferred embodiments. The housing 110 defines five socket-receiving locations 120, 130, 140, 150 and 160 that are each designed to receive a different-sized socket. The socket-receiving locations are uniquely-sized to accommodate only one of the five uniquely-sized sockets for which the socket holder 100 has been designed. Note that the term "uniquely-sized" as used herein means that each socket-receiving location in the socket holder has a unique size with respect to other socket-receiving locations in the socket holder, and each socket that is placed in the socket-receiving locations has a unique size with respect to other sockets in the socket holder.

The socket holder 100 includes slots 170 that allow the user of the socket holder 100 to hear sound from a small speaker that is placed within the housing 110 beneath the slots 170. The speaker plays audio messages that allow the socket holder 100 to "talk" to the user in response to the user selecting a tool-receiving location in the tool holder.

The tool holder 100 includes sensors 122, 132, 142, 152, and 162 that detect when a user selects one of the corresponding socket-receiving locations 120, 130, 140, 150 and 160. In the specific configuration shown in FIG. 1, the sensors are conductive contacts. Thus, socket receiving location 120 has a corresponding conductive contact 122; socket receiving location 130 has a corresponding conductive contact 132; socket receiving location 140 has a corresponding conductive contact 142; socket receiving location 150 has a corresponding conductive contact 152; and socket receiving location 160 has a corresponding conductive contact 162. The conductive contacts are placed in a location near the edge of the circumference of each socket-receiving location as shown. This configuration allows a socket placed within the correct-sized socket-receiving location to make contact with the conductive contact. If a socket is placed within an incorrect socket-receiving location that is too large, the socket will preferably not make contact with the conductive contact, thereby inhibiting the correct operation of the socket holder 100. In the first embodiment that includes the conductive contacts 122, 132, 142, 152 and 162 shown in FIG. 1, the conductive contacts are preferably coupled to a touch detector that detects when any of the sockets located within the socket holder 100 are touched by a human hand. Because the sockets are metal, they will conduct an electrical signal between the conductive contact and the user's hand. Touch detectors are well-known in the area of table-top lamps, which include circuits that detect when a user touches the lamp, allowing turning the lamp on and off by simply touching the lamp. The touch detectors used in the first embodiment 100 shown in FIG. 1 are preferably traditional touch detectors used for table-top lamps. Note, however, that any type of touch detector could be used within the scope of the preferred embodiments, whether currently known or developed in the future.

Figure 2:
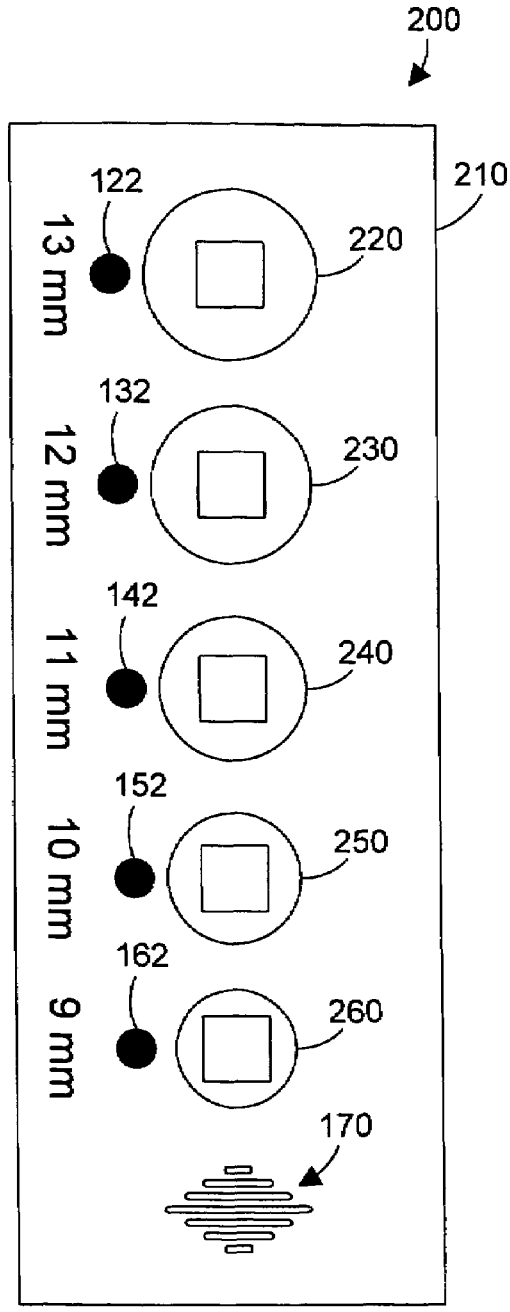
FIG. 2 is a top view of a talking tool holder in accordance with second and third embodiments.

Referring to FIG. 2, a socket holder 200 in accordance with a second embodiment includes a housing 210 that includes socket-receiving locations 220, 230, 240, 250 and 260 as shown. In the second embodiment, the sensors 122, 132, 142, 152 and 162 shown in FIG. 2 are switches. One preferred implementation of switches is small momentary push-button switches, such as membrane switches. In the second embodiment, the user selects a socket-receiving location in the tool holder 200 by pushing one of the buttons next to a socket-receiving location.

In the third embodiment, the sensors 122, 132, 142, 152 and 162 shown in FIG. 2 are light sensors. Light sensors are well-known in the art of night lights, which turn a night light on when an absence of ambient light is detected. The light sensors of the third embodiment may be simple light sensors used in night lights. The user may activate the light sensor by placing the tip of a finger over the light sensor. One disadvantage of using lights sensors is the socket holder 200 will not be able to detect when a user's finger is placed over the light sensor unless the tool holder 200 is in an area of relatively high ambient light. If the socket holder 200 is located in a place of relative darkness, such as under a car or outside when it's dark, the socket holder 200 will not be able to detect when the user tries to select a socket-receiving location, and will therefore not provide the desired audio information regarding the size of the socket.

Figure 3:
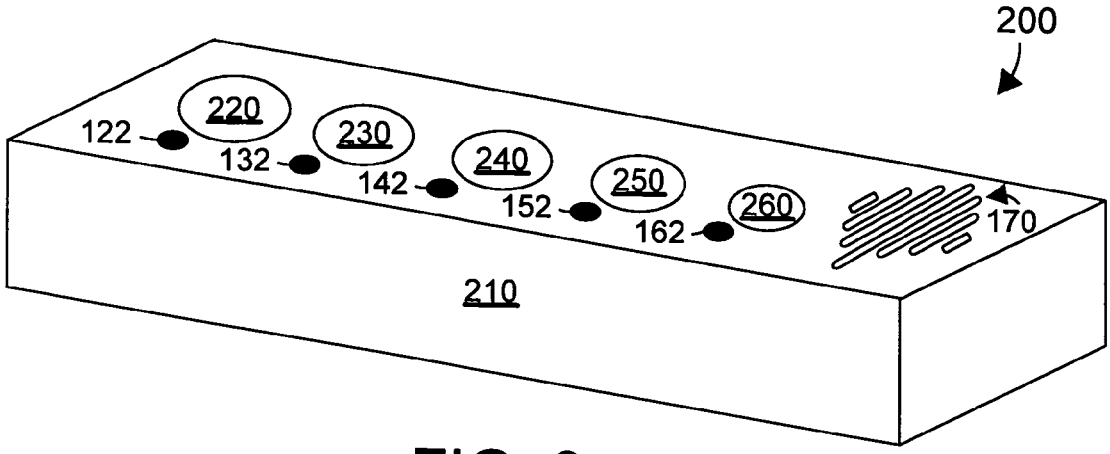
FIG. 3 is a perspective view of the talking tool holder of FIG. 2.
Figure 4:
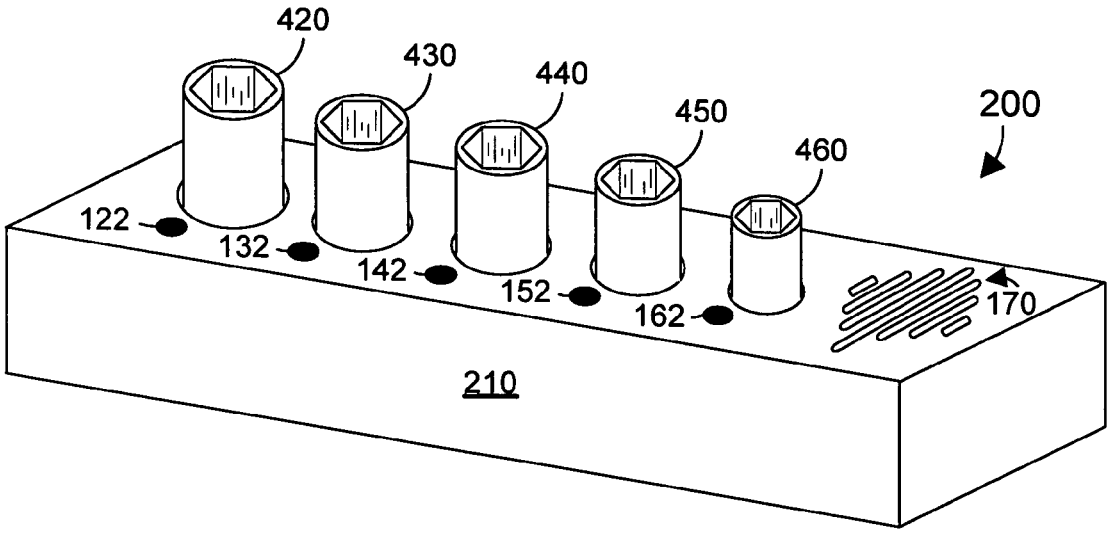
FIG. 4 is a perspective view of the talking tool holder of FIGS. 2 and 3 when filled with tools.

A perspective view of the socket holder 200 in FIG. 2 is shown in FIG. 3. The view in FIG. 3 is with the socket holder 200 empty. Now refer to FIG. 4, which shows the same perspective view of the socket holder 200 in FIG. 3, but with sockets 420, 430, 440, 450 and 460 in the respective socket-receiving locations 220, 230, 240, 250 and 260 shown in FIGS. 2 and 3. Note that the sensors 122, 132, 142, 152 and 162 may include push button switches or light sensors as described above.

Figure 5:
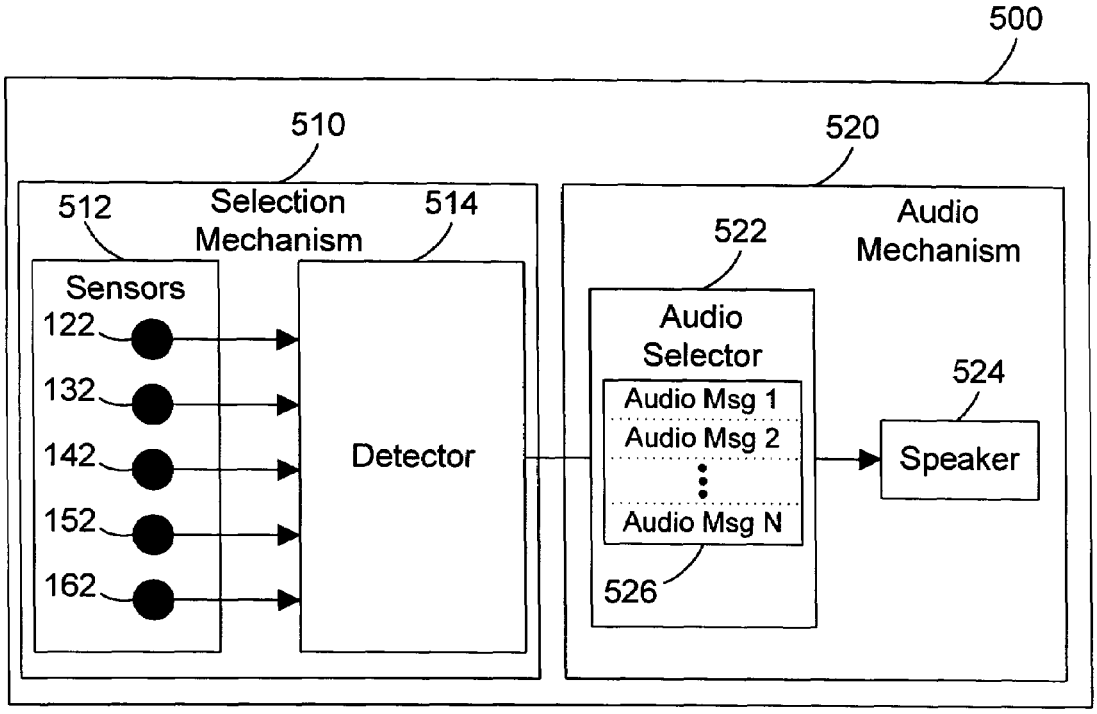
FIG. 5 is a block diagram showing functional blocks in the tool holder of the preferred embodiments.

Referring now to FIG. 5, a tool holder in accordance with the preferred embodiments includes a circuit 500 for providing audio information to a user when the user selects a tool-receiving location in the tool holder. The circuit 500 includes a selection mechanism 510 coupled to an audio mechanism 520. The selection mechanism 510 includes sensors 512 coupled to a detector 514. For the sake of illustration, sensors 122, 132, 142, 152 and 162 shown in FIGS. 1-4 are shown as sensors 512 in FIG. 5. The sensors 512 are coupled to an appropriate detector 514, which detects when the user actuates one of the sensors 512. The audio mechanism 520 includes an audio selector 522 coupled to a speaker 524. The audio selector 522 includes multiple audio messages 526, preferably one audio message for each sensor 512. The audio messages 526 are preferably pre-recorded messages that correspond to the tools stored in the tool holder. However, it is also within the scope of the preferred embodiments to allow the user to record one or more audio messages 526.

When the user makes a selection of a tool-receiving location on the tool holder by actuating one of the sensors 512, the detector 514 detects the user selection, and indicates to the audio selector 522 which sensor the user actuated. In response, the audio selector 522 selects an audio message corresponding to the actuated sensor, and plays the audio message on the speaker 524. In this manner, a user may select one of the tool-receiving locations, and an audio message is then played that corresponds to the selected tool-receiving location. In the most preferred implementation, the audio message indicates the size of the tool that the corresponding tool-receiving location is designed to hold. Thus, for the example in FIG. 1, when a user touches a socket placed within the tool-receiving location 130, an audio message will be played through the slots 170 that says "12 millimeters." This shows how the tool holder "talks" to a user. For the example in FIG. 2, when the user pushes a pushbutton corresponding to sensor 152, an audio message will be played through the slots 170 that says "10 millimeters."

Note that the audio mechanism 520 may be implemented in any suitable way, whether currently known or developed in the future. For example, the audio selector 522 could include a microcontroller or microprocessor that receives input from the detector 514, that reads a digital audio file from memory that corresponds to the user's selection, that outputs the digital audio file to an audio generator, which then plays the audio message corresponding to the selected digital audio file on the speaker 524. In another specific implementation, the audio selector 522 may be a state machine that simply recognizes the input from detector 514, and selects a recorded analog audio message to be output to the speaker 524. Any specific implementation of the audio mechanism 520 that is capable of performing the basic functions of receiving input from the detector 514 and playing a message corresponding to the sensor detected by the detector is within the scope of the preferred embodiments.

Speaker 524 may be a traditional cone-type speaker, or may be any other suitable audio device that is capable of playing audio information to the user, whether currently known or developed in the future. The most preferred implementation of speaker 524 is a small, inexpensive cone-type speaker that is placed within the housing underneath the slots 170.

Figure 6:
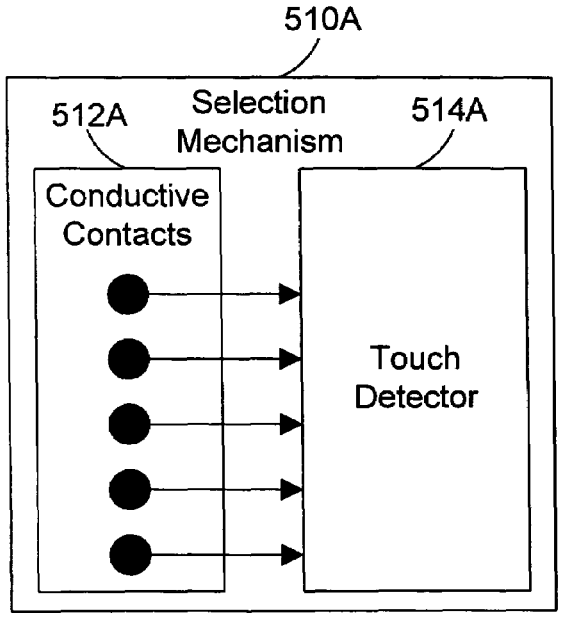
FIG. 6 is a block diagram showing a first possible implementation in accordance with the first embodiment for the selection mechanism shown in FIG. 5.

As explained with reference to FIGS. 1 and 2 above, the selection mechanism may use different technologies to allow a user to select a tool-receiving location in the tool holder. For example, a first specific implementation of selection mechanism 510 in FIG. 5 is shown as 510A in FIG. 6. In selection mechanism 510A, the sensors 512A are conductive contacts that make contact with the metal tools located in the tool-receiving locations. The conductive contacts are connected to a touch detector 514A. This configuration allows a user to simply touch a tool in the tool holder, and in response the tool holder will announce to the user audio information regarding the tool the user touched.

Figure 7:
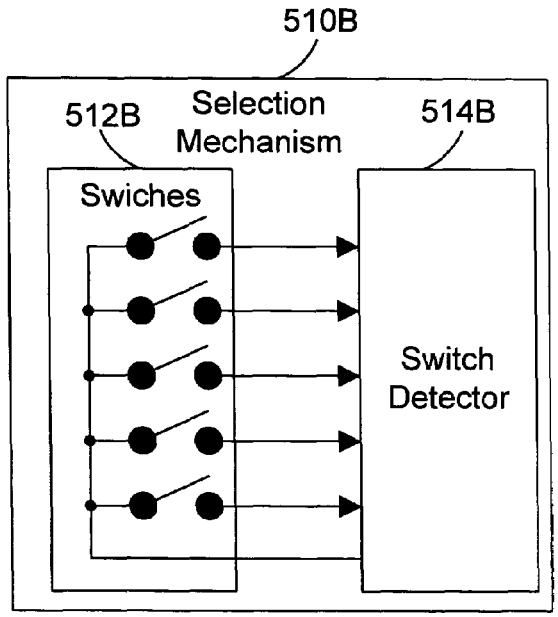
FIG. 7 is a block diagram showing a second possible implementation in accordance with the second embodiment for the selection mechanism shown in FIG. 5.

A second specific implementation of selection mechanism 510 in FIG. 5 is shown as 510B in FIG. 7. In selection mechanism 510B, the sensors 512B are switches, preferably momentary pushbutton switches, such as membrane switches. The switches 512B are connected to a switch detector 514B. Switch detector 514B is any suitable circuitry that is capable of detecting when a switch is open and closed. For example, switch detectors of many different kinds are known in the art relating to computer keyboards and other types of key switches. This configuration allows a user to simply push a button in proximity to a tool in the tool holder, and in response the tool holder will announce to the user audio information regarding the tool corresponding to the button pushed.

Figure 8:
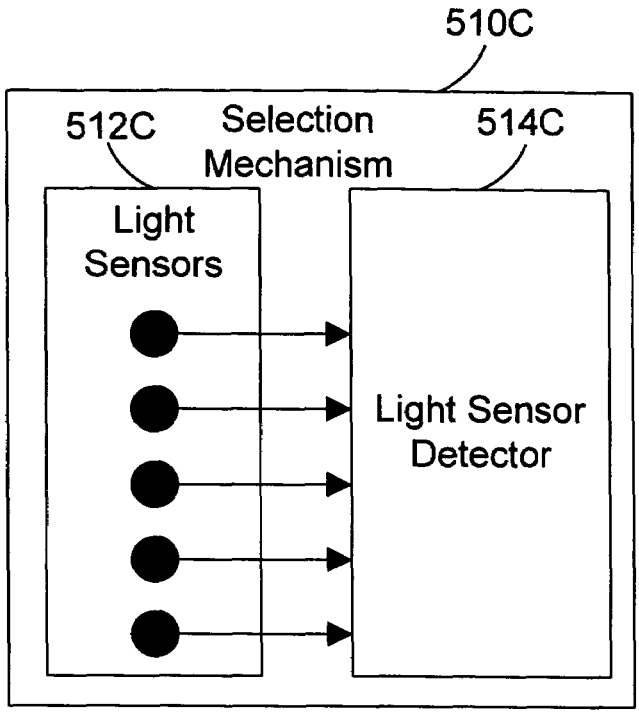
FIG. 8 is a block diagram showing a third possible implementation in accordance with the third embodiment for the selection mechanism shown in FIG. 5.

A third specific implementation of selection mechanism 510 shown in FIG. 5 is shown as 510C in FIG. 8. In selection mechanism 510C, the sensors 512C are light sensors that are coupled to a light sensor detector 514C. Many common light sensors known in the art provide a resistance that varies with the amount of light received by the light sensor. In this specific case, the light sensor detector 514C would simply determine whether the resistance of the light sensor indicates the light sensor is covered or not. In this specific example, a user makes a selection by placing a fingertip over the light sensor, thereby blocking all ambient light from entering the light sensor. Assuming an adequate level of ambient light is available, and light sensor detector 514C will detect the user's selection. This configuration allows a user to simply place a fingertip on top of a light sensor in proximity to a tool in the tool holder, and in response the tool holder will announce to the user audio information regarding the tool corresponding to the button.

Figure 9:
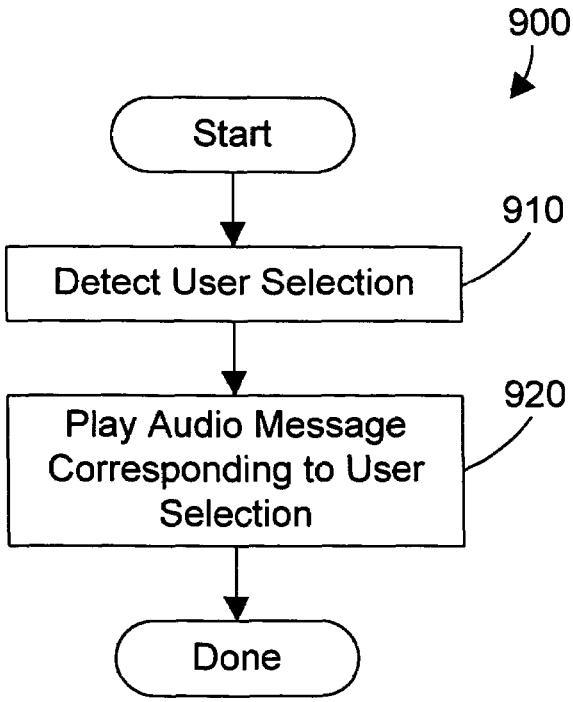
FIG. 9 is a flow diagram of a method in accordance with the preferred embodiments.

Referring to FIG. 9, a method 900 in accordance with the preferred embodiments detects a user selection of a tool or a tool-receiving location in the tool holder (step 910), and plays an audio message corresponding to the user's selection (step 920). In this manner, the tool holder of the preferred embodiments talks to the user, and tells the user information for the tool or tool-receiving location corresponding to the selection.

The combination of features of the preferred embodiments provide a tool holder that may be easily used by someone who is blind, who has poor vision, or who simply does not want to take the time to read the size of a tool from the tool itself or from the tool holder. One or more tools may be removed from the tool holder by the user selecting a tool or tool-receiving location, which causes the tool holder to play an audio message corresponding to the selected tool or tool-receiving location. When the tools need to be put away, the unique size of each tool-receiving location aids the user in putting the tools away in the proper place. While a smaller tool may be erroneously placed in a larger tool-receiving location, the user will easily spot this error when user attempts to put away the larger tool that is supposed to occupy the tool-receiving location. Thus, the combination of the housing of the tool holder that aids in putting tools in the proper tool-receiving location, the selection mechanism that allows a user to select a tool or tool-receiving location in the tool holder, and an audio mechanism responsive to the selection mechanism that plays an audio message corresponding to the selected tool or tool-receiving location is a significant advance over the known art in tool holders. A person of limited or no vision, or a person who simply does not want to have to look at the size of the tool, may use the tool holder of the preferred embodiments to select a tool using audio information instead of visually inspecting the tool or tool holder for visual information about the tool.

Note that the specific examples shown in the drawings herein are shown by way of example, and are not intended to be limiting. For example, a socket holder within the scope of the preferred embodiments could define tool-receiving locations that would receiving sockets laid on their side. In addition, while the specific tool holder shown in FIGS. 1-4 is a socket holder, one skilled in the art will recognize that a large number of different types of tool holders are within the scope of the preferred embodiments. For example, a tool holder that holds open-end/box-end wrenches is within the scope of the preferred embodiment, with the tool holder announcing to the user the size of the wrench that corresponds to the user's selection. A tool holder that holds screwdrivers is within the scope of the preferred embodiments, with the tool holder announcing to the user the size (small, medium, large) and type (phillips, slot, star) of the selected tool. One of ordinary skill in the art will recognize that the principles disclosed herein may be applied to many different types of tools to announce to the user information regarding a tool in the selected tool-receiving location.

Note that the principles disclosed herein could be used in a variety of different applications. For example, a medicine holder could hold multiple bottles of prescription medicine. When a user selects one of the bottles (or bottle-receiving locations), an audio message is played that indicates the medication stored in that bottle. In another example, audio messages could be recorded regarding the contents of file drawers in a filing cabinet, and an audio message corresponding to a user-selected file drawer could then activate the audio message that indicates the contents of the file drawer. The specific examples recited herein are provided as very general examples, and are not in any way limiting of the invention. The preferred embodiments expressly extend to playing an audio message corresponding to a user selection in response to the user selection, regardless of the specific application. In addition, other features could be incorporated into the tool holder of the preferred embodiments, such as a flashlight, a display that shows the size of the selected tool in large digits or letters, etc.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention.

What is claimed is:

1. A tool holder comprising:

a housing that includes a plurality of tool-receiving locations;

a plurality of finger-actuated sensors coupled to the housing in proximity to the plurality of tool-receiving locations that allow a user to select with a finger any of the plurality of tool-receiving locations in the housing by actuating a corresponding one of the plurality of finger-actuated sensors; and an audio mechanism responsive to the plurality of finger-actuated sensors that plays an audio message corresponding to the selected tool-receiving location when the user actuates the corresponding finger-actuated sensor.

2. The tool holder of claim 1 wherein each tool-receiving location is configured to receive a tool of a specified size.

3. The tool holder of claim 2 wherein the audio message indicates the specified size of the tool corresponding to the selected tool-receiving location.

4. The tool holder of claim 1 wherein each tool-receiving location is configured to receive a tool of a different size than the other tool-receiving locations.

5. The tool holder of claim 1 wherein each of the plurality of finger-actuated sensors comprise at least one conductor coupled to at least one touch detector.

6. The tool holder of claim 1 wherein each of the plurality of finger-actuated sensors comprise at least one switch coupled to a switch detector.

7. The tool holder of claim 1 wherein each of the plurality of finger-actuated sensors comprise at least one light sensor coupled to a light sensor detector.

8. The tool holder of claim 1 wherein the audio mechanism includes a different audio message for each tool-receiving location.

9. A tool holder comprising:

a housing that includes a plurality of uniquely-sized tool-receiving locations that may each receive a corresponding tool of a unique size;

a plurality of finger-actuated sensors that allow a user to select with a finger any of the tool-receiving locations in the housing by actuating a corresponding one of the plurality of finger-actuated sensors; and an audio mechanism responsive to the plurality of finger-actuated sensors that plays an audio message that indicates the unique size of the tool that corresponds to the selected tool-receiving location when the user actuates the corresponding finger-actuated sensor.

10. The tool holder of claim 9 wherein each of the plurality of finger-actuated sensors comprise at least one conductor coupled to at least one touch detector.

11. The tool holder of claim 9 wherein each of the plurality of finger-actuated sensors comprise at least one switch coupled to a switch detector.

12. The tool holder of claim 9 wherein each of the plurality of finger-actuated sensors comprise at least one light sensor coupled to a light sensor detector.

13. The tool holder of claim 9 wherein the audio mechanism includes a different audio message for each tool-receiving location.

14. A method for providing audio information regarding a tool located in a tool holder that comprises a plurality of finger-actuated sensors that correspond to a plurality of tool-receiving locations, the method comprising the steps of:

a user selecting with a finger a tool located in the tool holder by actuating one of the plurality of finger-actuated sensors that corresponds to the tool; and in response to actuating the one finger-actuated sensor, playing an audio message corresponding to the selected tool.

15. The method of claim 14 wherein the audio message indicates size of the selected tool.

16. The method of claim 14 wherein the tool holder comprises a plurality of tool-receiving locations, and wherein the step of a user selecting with a finger the tool in the tool holder by actuating one of the plurality of finger-actuated sensors that corresponds to the tool comprises the step of selecting one of the plurality of tool-receiving locations.

17. The method of claim 16 wherein each tool-receiving location is configured to receive a tool of a specified size.

18. The method of claim 14 wherein the step of a user selecting with a finger a tool located in the tool holder by actuating one of the plurality of finger-actuated sensors that corresponds to the tool comprises the step of touching the tool.

19. The method of claim 14 wherein the step of a user selecting with a finger a tool located in the tool holder by actuating one of the plurality of finger-actuated sensors that corresponds to the tool comprises the step of actuating a switch in proximity to the tool.

20. The method of claim 14 wherein the step of a user selecting with a finger a tool located in the tool holder by actuating one of the plurality of finger-actuated sensors that corresponds to the tool comprises the step of actuating a light sensor in proximity to the tool.

21. The method of claim 14 further comprising the step of playing a different audio message for each tool located in the tool holder.

22. A method for indicating size of a tool located in a tool holder that includes a plurality of uniquely-sized tool-receiving locations that may each receive a corresponding uniquely-sized tool, the method comprising the steps of:

a user selecting one of the tool-receiving locations by actuating a finger-actuated sensor in the tool holder that corresponds to the tool; and in response to the user actuating the finger-actuated sensor, playing an audio message that indicates the unique size of the tool that corresponds to the selected tool-receiving location.

23. The method of claim 22 wherein the step of the user selecting one of the tool-receiving locations by actuating a finger-actuated sensor in the tool holder that corresponds to the tool comprises the step of the user touching the tool.

24. The method of claim 22 wherein the step of the user selecting one of the tool-receiving locations by actuating a finger-actuated sensor in the tool holder that corresponds to the tool comprises the step of the user actuating a switch in proximity to the tool.

25. The method of claim 22 wherein the step of the user selecting one of the tool-receiving locations by actuating a finger-actuated sensor in the tool holder that corresponds to the tool comprises the step of the user actuating a light sensor in proximity to the tool.

26. The method of claim 22 further comprising the step of playing a different audio message for each tool located in the tool holder.

27. A tool holder comprising:

a housing that includes a plurality of tool-receiving locations, each tool-receiving location configured to receive a tool of a different size than the other tool-receiving locations;

a plurality of switches coupled to the housing in proximity to the plurality of tool-receiving locations that allow a user to select with a finger any of the plurality of tool-receiving locations in the housing by actuating a corresponding one of the plurality of switches; and an audio mechanism responsive to the plurality of switches that plays a different audio message when each of the plurality of switches is actuated.

28. The tool holder of claim 27 wherein the audio message indicates size of the tool corresponding to the selected tool-receiving location.

29. A method for a tool holder to play an audio message, the tool holder comprising a plurality of switches in proximity to a corresponding plurality of tool-receiving locations, each tool-receiving location configured to receive a tool of a different size than the other tool-receiving locations, the method comprising the steps of:

a user actuating with a finger a switch in proximity to a desired tool-receiving location;

detecting when the user actuates the switch; and in response to the user actuating the switch, playing an audio message corresponding to the selected tool-receiving location.

30. The method of claim 29 wherein the audio message indicates size of the tool corresponding to the selected tool-receiving location.

* * * * *